United States Patent [19]

Kourogi et al.

[11] Patent Number: 4,966,518

[45] Date of Patent: Oct. 30, 1990

[54] APPARATUS FOR CONTROLLING POSTURE OF FRONT LOADER

[75] Inventors: Isao Kourogi; Masami Hirooka, both of Osaka, Japan

[73] Assignee: Kubota Ltd., Osaka, Japan

[21] Appl. No.: 230,779

[22] Filed: Aug. 10, 1988

[30] Foreign Application Priority Data

Aug. 12, 1987 [JP] Japan ..... 62-202321
Aug. 12, 1987 [JP] Japan ..... 62-202326

[51] Int. Cl.[5] ..... E02F 3/00

[52] U.S. Cl. ..... 414/700; 414/708; 414/701; 414/697

[58] Field of Search ..... 414/5, 685, 706, 707, 414/708, 700, 710, 712, 702, 701, 698, 697, 686

[56] References Cited

U.S. PATENT DOCUMENTS

| | | | |
|---|---|---|---|
| 2,914,202 | 11/1959 | Wagner | 414/700 |
| 3,029,961 | 4/1962 | Sagerer | 414/702 |
| 3,197,051 | 7/1965 | Thickpenny | 414/701 |
| 3,251,492 | 5/1966 | Kampert | 414/698 |
| 3,275,174 | 9/1966 | Konefes | 414/698 |
| 3,713,557 | 1/1973 | Seaberg et al. | 414/700 |
| 3,726,428 | 4/1973 | Lark | 414/700 |
| 3,872,990 | 3/1975 | York | 414/700 |
| 4,375,344 | 3/1983 | Baum et al. | 414/708 |
| 4,431,364 | 2/1984 | Redenbarger et al. | 414/706 X |
| 4,737,067 | 4/1988 | Samejima et al. | 414/686 |

*Primary Examiner*—Robert J. Spar
*Assistant Examiner*—James T. Eller

[57] ABSTRACT

An apparatus for controlling the posture of a front loader has booms attachable to a vehicle body which are pivotally movably upward and downward and has a work implement attached to the forward ends of the booms and pivotally movable in a scooping direction and a dumping direction. Each of the booms and the implement are pivotally movable by a single control lever independently of each other or movable simultaneously. The apparatus includes an actuating member for shifting the control lever from a boom raising position to a boom raising and dumping position when the booms are not positioned lower than a specified level. This eliminates the likelihood of the implement tilting rearwardly downward even if the booms are raised, precluding the implement from spilling the earth or sand scooped up.

17 Claims, 8 Drawing Sheets

APPARATUS FOR CONTROLLING POSTURE OF FRONT LOADER

FIELD OF THE INVENTION AND RELATED ART STATEMENT

The present invention relates to an apparatus for controlling the posture of a front loader having booms and a work implement for use in operating the booms and the implement independently of each other and at the same time using a single control lever.

Front loaders attached to tractors or like vehicles are adapted to scoop up earth or sand and carry the earth or sand to a site of higher level with a work implement by operating each boom and the implement independently of each other and also at the same time using a single control lever.

When the booms of the front loader are raised with earth scooped up with its implement, the implement becomes tilted rearwardly downward as the booms rise, causing some earth to spill rearward from the implement at a raised position.

To preclude such spillage, there arises a need to correct the posture of the front loader by turning the implement toward the dumping direction when raising the booms. However, this procedure requires skill when executed with the single control lever.

OBJECT AND SUMMARY OF THE INVENTION

The main object of the present invention is to provide a posture control apparatus for use with such front loaders for automatically turning the work implement toward the dumping direction before the implement tilts rearwardly downward the booms, permitting earth, sand or the like to spill from the implement, so as to prevent spillage without requiring a lot of skill.

The invention will be summarized below.

Actuating means is provided for shifting a control lever from a boom-up (boom raising) position to a boom-up and implement-dumping (implement unloading) position when each boom of the front loader is brought to a position not lower than a specified level, whereby when the booms are brought to the specified level, the implement is automatically pivotally moved toward the dumping direction and thereby precluded from tilting rearwardly downward to prevent spillage of earth without necessitating any skillful manipulation.

Preferably, boom position detecting means is provided for detecting whether each boom is positioned not lower than the specified level. When the detecting means detects that the boom is positioned not lower than the specified level, the actuating means shifts the control lever from the boom-up position to the boom-up and implement-dumping position.

Owing to the provision of the boom position detecting means, the actuating means is precluded from shifting the control lever until the boom is positioned not lower than the specified level.

Preferably, implement position detecting means is provided for detecting whether the work implement is positioned as pivotally moved at least through a specified angle in the scooping direction relative to the boom. The actuating means shifts the control lever from the boom-up position to the boom-up and implement-dumping position upon the boom position detecting means detecting that the boom is positioned not lower than the specified level and upon the implement position detecting means detecting that the implement is positioned as pivotally moved at least through the specified angle in the scooping direction relative to the boom.

When the implement position detecting means detects that the implement is not positioned as thus moved, the implement does not tilt rearwardly downward and does not permit spillage of earth even if the boom is raised beyond the specified level, so that the control lever is not shifted by the actuating means.

Preferably, the boom position detecting means is operatively connected to the actuating means by a push-pull cable. When the boom is pivotally moved to the specified level or higher, the push-pull cable is operated in a direction to operate the actuating means. The implement position detecting means is operatively connected to a pivotal arm. The push-pull cable has an outer wire axially movably supported by the pivotal arm. The movement of the pivotal arm brings the outer wire selectively into a state involving an axial play or into a state involving no axial play. When the implement position detecting means detects that the implement is positioned as pivotally moved at least through the specified angle in the scooping direction relative to the boom, the pivotal arm is moved in a direction to eliminate the play of the outer wire.

Thus, the outer wire of the push-pull cable operatively connecting the boom position detecting means to the actuating means no longer plays when the implement is positioned as pivotally moved at least through the specified angle in the scooping direction relative to the boom, whereas the wire plays when the implement is positioned otherwise. In the state of the outer wire involving no play, the actuating means shifts the control lever when the boom is positioned at the specified level or higher. In the state of the outer wire having play, there is no likelihood that the actuating means will shift the control lever even if the boom is positioned at the specified level or higher.

Preferably, a control box having the boom position detecting means and the control lever is disposed in the vicinity of the pivot of the boom of the front loader.

This positions the control lever close to the boom position detecting means, diminishes the movement thereof relative to each other and permits use of smaller members for operatively connecting one to the other. Further when the front loader is to be removed, the detecting means and the control lever are removable along with the front loader.

Preferably, the implement position detecting means is provided on one side face of the boom above the pivot for the implement.

This renders the implement position detecting means less likely to strike against obstacles and to be exposed to mud.

Preferably, the actuating means comprises an actuating member which is pivotably disposed in the vicinity of the control lever.

Preferably, the actuating means is provided with a slanting guide by which the control lever as shifted from the boom-up position to the boom-up and implement-dumping position is so guided as to move between the latter position and a neutral position.

When the boom is positioned at the specified level or higher, the operator may attempt to shift the control lever from the neutral position to the boom-up position, but the slanting guide leads the control lever to the boom-up and implement-dumping position, whereby spillage of earth is prevented.

Preferably, the boom position detecting means comprises a cam connected to the boom and a detecting arm connected to a member attachable to the vehicle body. The detecting arm is operatively connected to the actuating means. The detecting arm is moved by the cam in a direction to operate the actuating means when the boom is pivotally moved to the specified level or higher.

Preferably, the detecting arm of the boom position detecting means is movable about a pivot, and the actuating member is movable about a pivot. The detecting arm is operatively connected to the actuating member by the push-pull cable.

Preferably, the implement position detecting means comprises a cam connected to the implement and a detecting arm connected to the boom. This detecting arm is operatively connected to the pivotal arm.

Preferably, the cam of the implement position detecting means is mounted on a rod, and the rod is pivoted to the implement by a pin and held by a guide sleeve pivoted to the boom by a pin and extending along the boom. The detecting arm is movable about a pivot, the pivotal arm is movable about a pivot, and the detecting arm is operatively connected to the pivotal arm by a push-pull cable.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 1 is a side elevation in section showing a control unit included in a front loader;

FIG. 2 is a rear view in section showing the same;

FIG. 3 is a plan view in section showing the same;

FIG. 4 is a side elevation showing a tractor and the front loader;

FIG. 5 is a plan view in section showing a control lever and parts associated therewith;

FIG. 6 is a side elevation of implement detectting-disengaging means;

FIG. 7 is a side elevation of boom position detecting means and boom detecting-disengaging means;

FIG. 8 is a plan view in section for illustrating the movement of the control lever;

FIG. 9 is a side elevation in section showing a control unit for a front loader;

FIG. 10 is a rear view in section showing the same;

FIG. 11 is a plan view in section of the same;

FIG. 12 is a plan view partly broken away and showing the same;

FIG. 13 is a side elevation showing the front loader and a tractor;

FIG. 14 is a side elevation of implement position detecting means and implement detecting-disengaging means; and FIG. 15 is a plan view partly broken away and showing the control unit in a state different from that shown in FIG. 12.

DESCRIPTION OF THE PREFERRED EMBODIMENTS

The first preferred embodiment will be described with reference to FIGS. 1 to 8.

Figure 4:
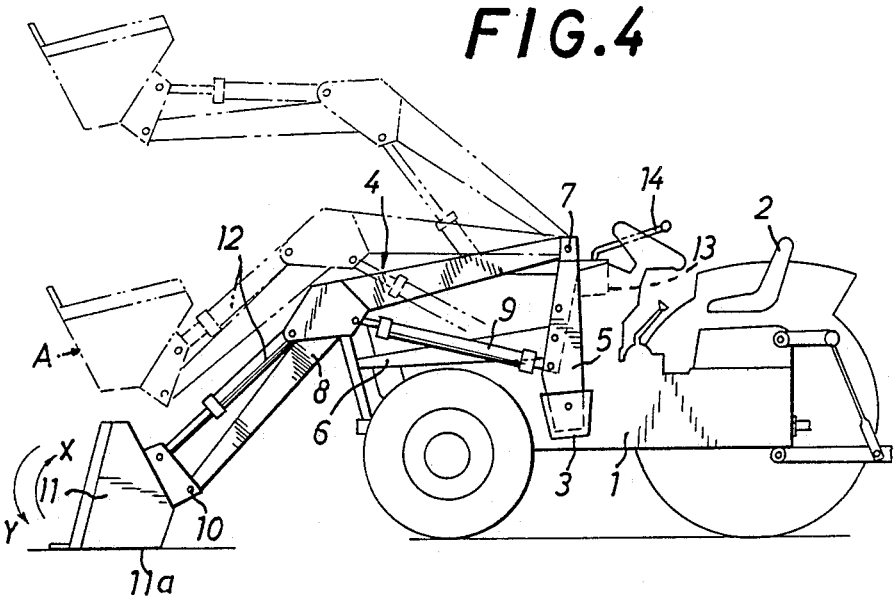

FIG. 4 shows a front loader of the bucket type as attached to a tractor for use. With reference to FIG. 4, the body 1 of the tractor has a driver's seat 2, and a mount 3 which is provided at each side of the tractor body 1.

The front loader 4 comprises an upright 5 removably attached to the mount 3, a brace 6 extending forward from the upright 5 and removably fixed to the front end of the tractor body 1, a boom 8 supported by a pivot 7 on the upper end of the upright 5 and movable upward and downward, a boom cylinder 9 for moving the boom 8 upward and downward, a bucket (work implement) 11 supported by a pivot 10 on the forward end of the boom 8 and movable upward and downward in a scooping direction and a dumping direction, and a bucket cylinder (implement cylinder) 12 for pivotally moving the bucket 11.

The upright 5, brace 6, boom 8, boom cylinder 9 and bucket cylinder 12 are disposed at each side of the tractor body 1.

Figure 1:
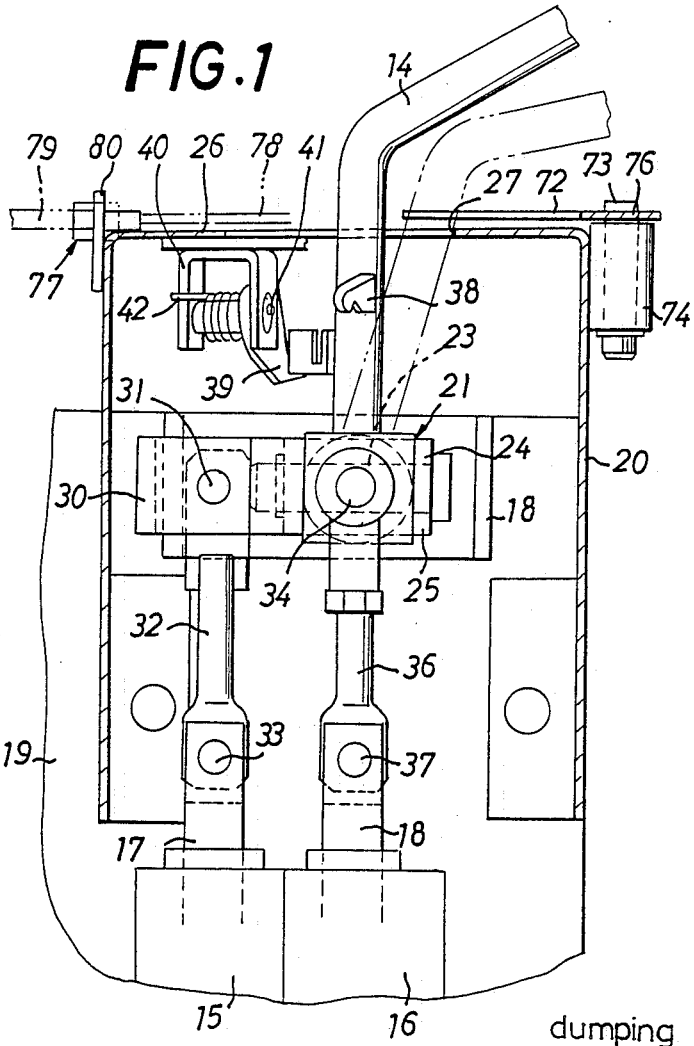
FIGS. 1 to 8 show a first preferred embodiment of the invention.
Figure 3:
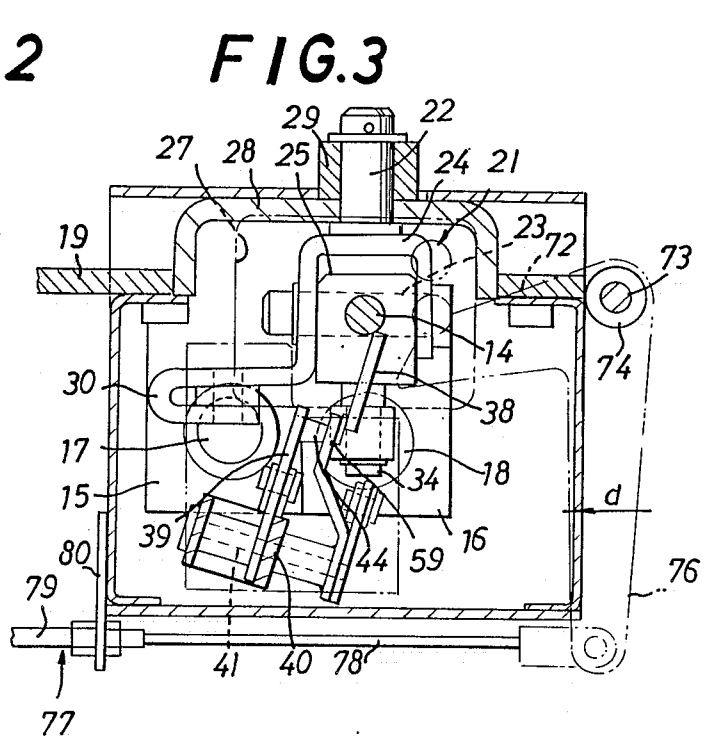
Figure 2:
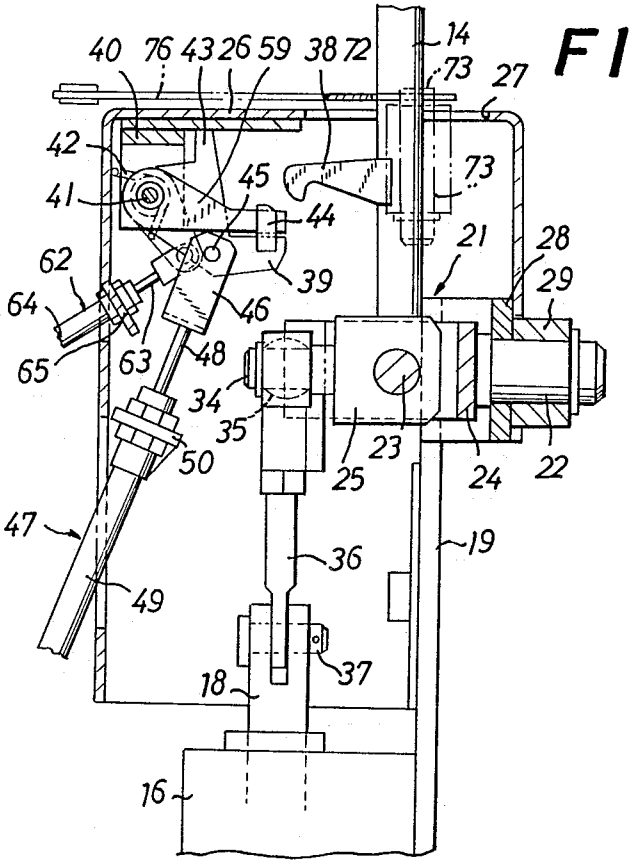

A control unit 13 is attached to the right upright 5, has a single control lever 14 and is of the construction shown in FIGS. 1 to 3.

With reference to FIGS. 1 to 3, a boom control valve 15 for controlling the boom cylinders 9, and a bucket control valve 16 (implement control valve) for controlling the bucket cylinders 12 are shown. These control valves 15 and 16 are three-way change-over valves of the spool type and are fixed to a mount plate 19 with spools 17 and 18 so arranged as to move vertically. The mount plate 19 is fixed to the upright 5.

A control box 20 is positioned above the control valves 15, 16 and fixed to the mount plate 19. Housed in the control box 20 is an interlocking assembly 21 for rendering the control valves 15, 16 operable independently of each other or simultaneously operable by the single control lever 14.

The interlocking assembly 21 includes a first pivot 22 and a second pivot 23 positioned at right angles with respect to each other, a first pivotal member 24 movable about the axis of the first pivot 23, and a second pivotal member 25 movable about the axis of the second pivot 23. The control lever 14 is secured to the second pivotal member 25. The control lever 14 extends upward through an opening 27 formed in the top plate 26 of the control box 20.

The first pivotal member 24 is U-shaped when seen from above and has the first pivot 22 attached to its right side with its axis extending transversely of the loader. The first pivot 22 is rotatably inserted in a boss portion 29 secured to a bracket 28 on the mount plate 19. The first pivotal member 24 has an arm portion 30 projecting forward and connected to the spool 17 of the boom control valve 15 by a pin 31, rod 32 and pin 33.

The second pivotal member 25 is surrounded by the first pivotal member 24 and rotatably supported by the second pivot 23 having an axis extending in the front-to-rear direction. The second pivot 23 is supported by the first pivotal member 24. The second pivotal member 25 has on its left side a projection 34 coaxial with the first pivot 22. The projection 34 is connected to the spool 18 of the bucket control valve 16 by a ball support member 35, rod 36 and pin 37.

Because of the above arrangement, the control lever 14 is pivotally movable forward and rearward about the axis of the first pivot 22, moving the spool 17 of the control valve 15 therewith. The lever 14 lowers the booms 8 when moved forward or raises the booms 8 when moved rearward.

The control lever 14 is pivotally movable also rightward and leftward about the second pivot 23 to move the spool 18 of the control valve 16 therewith. The leftward movement moves the bucket 11 in a scooping direction (direction of arrow X in FIG. 4). The rightward movement moves the bucket 11 in a dumping direction (direction of arrow Y in FIG. 4).

Since the first pivotal member 24 is movable about the axis of the first pivot 22 and since the second pivotal member 25 is movable about the second pivot 23, the control lever 14 is pivotally movable in intermediate directions between the front-to-rear direction and the lateral direction. When moved in such an intermediate direction, the lever 14 moves the spools 17, 18 of the control valves 15, 16, thereby moving the booms 8 and the bucket 11 at the same time.

A latch portion 38 is projected from the base portion of the control lever 14 leftward slightly forward and has a left end which is hooked at its lower side.

Figure 5:
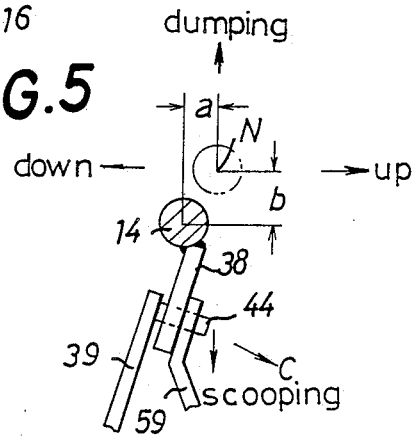

An engaging member 39, which is movable upward and downward about a pivot 41, is supported by an inverted U-shaped bracket 40 attached to the lower side of the top plate 26 of the control box 20. The engaging member 39 has a stopper portion 43 and is biased upward by a coiled spring 42 to bring the stopper portion 43 into contact with the top plate 26. The engaging member 39 has at its free end a rearward projection 44. The latch portion 38 releasably engages with the projection 44 from above when the control lever 14 is shifted to a scooping position for the bucket 11 by being forwardly moved from a neutral position N to a boom lowering (boom-down) position by a distance a and also moved leftward by a distance b as seen in FIG. 5. The engagement restrains the control lever 14 from shifting rightward under the action of a spring (not shown) for returning the spool 18 to its neutral position.

A push-pull cable 47 includes an inner wire 48 connected to the engaging member 39 by a pin 45 and a connector 46, and an outer wire 49 attached to a holder 50 provided on the control box 20 and disposed below the engaging member 39. The inner wire 48, when pulled, moves the engaging member 39 downward about the pivot 41 out of engagement with the latch portion 38. The push-pull cable 47 is operatively connected to implement detecting-disengaging means 51. When the bucket 11 is detected as moved through a specified angle relative to the boom 8, the cable moves the engaging member 39 in a direction out of engagement with the latch portion 38.

Figure 6:
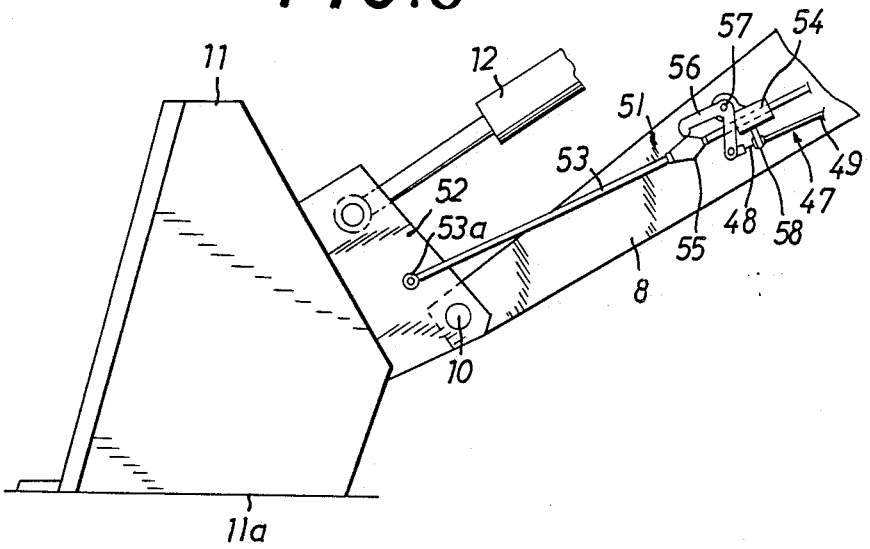

The implement detecting-disengaging means 51 comprises a rod 53 extending along the boom 8 pivoted to a bracket 52 on the bucket 11 by a pin 53*a* above the pivot 10 as seen in FIG. 6. The means 51 further has a guide sleeve 54 slidably holding the free end portion of the rod 53, a cam 55 provided on the rod 53, and an L-shaped detecting arm 56.

The guide sleeve 54 and the detecting arm 56 are pivoted to the boom 8 by a pin 57. The detecting arm 56 is moved by the cam 55 when the bucket 11 is positioned at an angle with the boom 8 at which the bottom side 11*a* of the bucket 11 can be horizontally placed on the ground. For this purpose, the cam 55 is in contact with one end of the detecting arm 56. The detecting arm 56 is connected at the other end thereof to the other end of the inner wire 48 of the cable 47. The other end of the outer wire 49 of the cable 47 is attached to a holder 58 secured to the guide sleeve 54.

A stopper 59 is disposed behind the engaging member 39. The stopper 59 is supported by the pivot 41 to be upwardly and downwardly movable. The stopper 59 is engageable with the latch portion 38 in engagement with the projection 44 of the engaging member 39 to restrain the control lever 14 from shifting rearward under the action of a spring (not shown) for returning the spool 17 to its neutral position. A push-pull cable 62 has an inner wire 63 connected to the stopper 59 and an outer wire 64 attached to a holder 65 on the control box 20. The push-pull wire 62 is operatively connected to boom detecting-disengaging means 66 to pivotally move the stopper 59 downward and release the latch portion 38 from the stopper 59 upon the booms 8 lowering to a transport position A shown in FIG. 4 during their downward movement.

Figure 7:
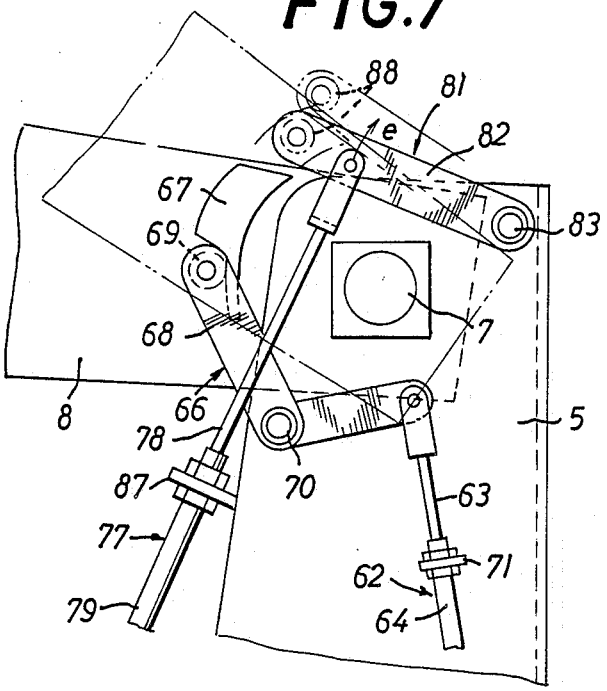

With reference to FIG. 7, the boom detecting-disengaging means 66 has a cam 67 attached to the rear end of the boom 8 on one side thereof, a detecting arm 68 resembling a bell crank and movably supported by a pivot 70, a cam roller 69 provided at the free end of the detecting arm 68, and a spring (not shown) for biasing the arm 68 to hold the cam roller 69 in contact with the cam 67.

The inner wire 63 of the push-pull cable 62 is connected to the detecting arm 68, while the outer wire 64 of the cable 62 is attached to a holder 71 secured to the upright 5. The face of the cam 67 in contact with the cam roller 69 is stepped so that the arm 68 moves counterclockwise to pull the inner wire 63 when the boom 8 lowers below the transport position A. Accordingly, when the boom 8 moves downward from the transport position A, the stopper 59 also moves downward out of engagement with the latch portion 38.

Figure 8:
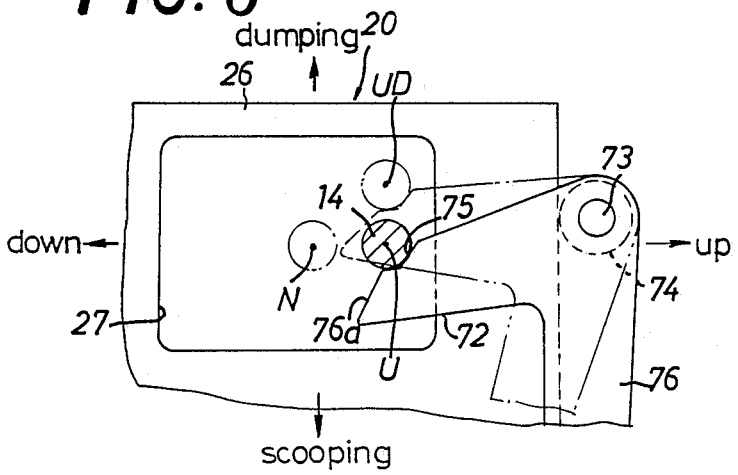
Figure 11:
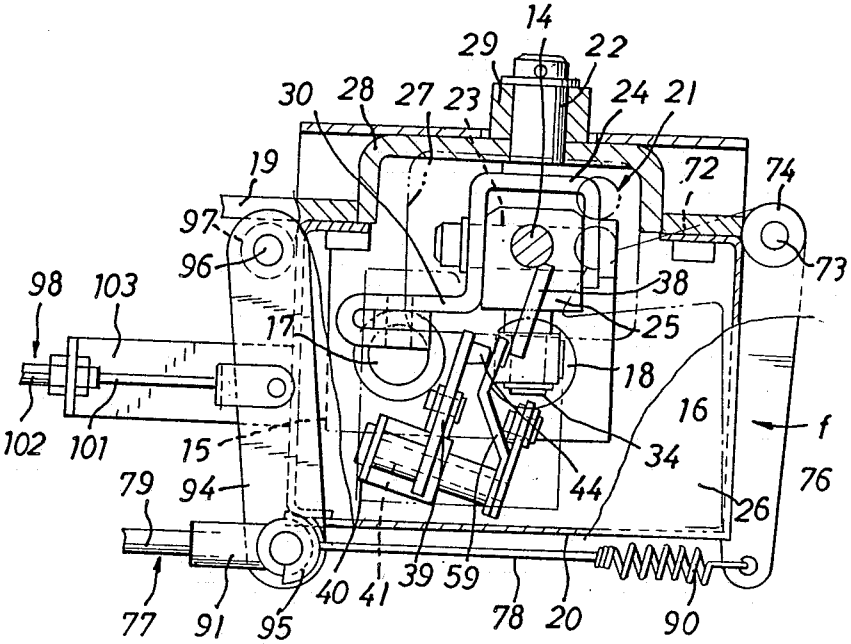
Figure 10:
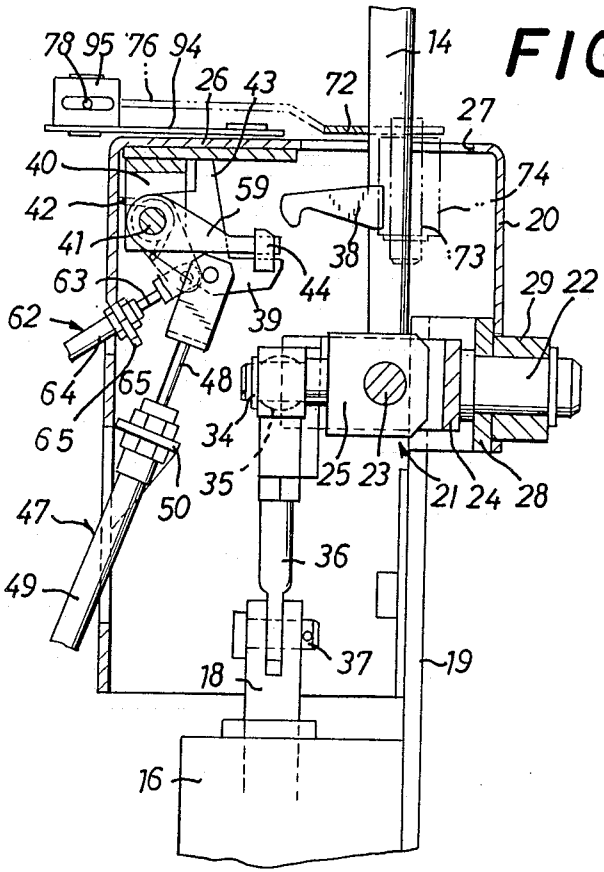

As seen in FIG. 8, an actuating member 72 is provided on the top side of the control box 20. The actuating member 72 is adapted to forcibly shift the control lever 14 from a boom-up (boom raising) position U to a boom-up and bucket-dumping (bucket unloading) position UD.

The actuating member 72 carries at its rear end a pivot 73, which is inserted in a tubular portion 74 of the control box 20, whereby the member 72 can move about the pivot 73. Further as shown in FIG. 8, the actuating member 72 has an engaging portion 75 in the form of a circular-arc cutout. When the engaging portion 75 is positioned to the rear of the neutral position N, the control lever 14 in the boom-up position U is in engagement with the engaging portion 75. The actuating member 75 has a front face serving as a slanting guide 76*a*, whereby the control lever 14 is guided to move between the positions N and UD.

The actuating member 72 has a lever 76. With reference to FIG. 3, a push-pull cable 77 has an inner wire 78 connected to the lever 76 and an outer wire 79 attached to a holder 80 on the control box 20. The lever 76 is operatively connected by the cable 77 to boom position detecting means 81 for operating the actuating member 72 when detecting that the boom is positioned at a specified level or higher.

With reference to FIG. 7, the boom position detecting means 81 has a detecting arm 82 movable by the upper end of the cam 67 and supported by a pivot 83 on the upright 5 to be upwardly and downwardly movable. The inner wire 78 of the cable 77 is connected to the detecting arm 82, and the outer wire 79 thereof to the upright 5 by a holder 87. The detecting arm 82 carries a cam roller 88 at its forward end.

The operation of the present embodiment will now be described. When the control lever 14 is positioned for dumping with the each boom 8 in its most raised position, the second pivotal member 25 moves about the second pivot 23, pulling up the spool 18 of the bucket control valve 16 through the projection 34 and the rod 36 and thereby extending the bucket cylinders 12, whereby the bucket 11 is moved about the pivot 10 toward the dumping direction to dump earth.

From this state, the control lever 14 is returned to the neutral position N and then shifted from the neutral position N toward the lowering direction by the distance a and also toward the scooping direction by the distance b, whereby the lever 14 is brought to the boom-down and bucket-scooping (scooping with the bucket 11) position, whereupon the latch portion 38 engages the projection 44 of the engaging member 39 from above, locking the control lever 14 in the shifted position. The shift of the lever 14 moves the first pivotal member 24 about the axis of the first pivot 22, causing the arm portion 30 and the rod 32 to depress the spool 17 of the boom control valve 15 and thereby contract the boom cylinders 9, whereby the booms 8 are moved downward about the pivot 7. At the same time, the second pivotal member 25 moves about the second pivot 23, causing the rod 36 to depress the spool 18 of the bucket control valve 16. Consequently, the bucket cylinders 12 are contracted, moving the bucket 11 about the pivot 10 toward the scooping direction. In this way, the booms 8 are lowered and the bucket 11 is moved for scooping at the same time.

The engaging member 39 in engagement with the latch portion 38 locks the control lever 14 in the boom-down and bucket-scooping position. The forces of the return springs incorporated in the boom control valve 15 and the bucket control valve 16 are delivered through the spools 17, 18 to the control lever 14 thus locked, acting to return the lever to the neutral position N. Thus, with the return spring in the boom control valve 15 biasing the control lever 14 rearward, the latch portion 38 acts to move out of engagement with the projection 44 of the engaging member 39 in the direction of arrow c in FIG. 5. However, the stopper 59 restrains the latch portion 38 from this movement. Further since the hooked end of the latch portion 38 is in engagement with the projection 44 from above, the lever 14 is prevented from moving rightward. Consequently, the control lever 14 can be reliably locked.

Next, when the booms 8 reach the transport position A while lowering, the cam 67 moves the detecting arm 68 counterclockwise through the cam roller 69, causing the inner wire 63 to pivotally move the stopper 59 downward out of engagement with the latch portion 38. As a result, the return spring of the boom control valve 15 forces the control lever 14 rearward, so that the lever 14 is shifted toward the direction of arrow c in FIG. 5 with the latch portion 38 in engagement with the engaging member 39, whereby the spool 17 of the valve 15 is returned to its neutral position to stop the booms 8 at the transport position A.

On the other hand, when the rod 53 is pushed rearward by the scooping movement of the bucket 11 about the pivot 10, the cam 55 is brought closer to the detecting arm 56. When the bucket 11 is positioned at an angle with the boom 8 at which the bottom side 11*a* of the bucket 11 is horizontally positioned in contact with the ground, the cam 55 rotates the detecting arm 56 about the pin 57 clockwise. The arm 56 in turn pulls the inner wire 48 of the push-pull cable 47 to pivotally move the engaging member 39 downward against the spring 42 out of engagement with the latch portion 38.

Consequently, the return spring of the bucket control valve 16 returns the control lever 14 rightward to the neutral position N, with the spool 18 also returned to its neutral position, whereby the bucket 11 is halted.

The control lever 14, when shifted toward the lowering direction, moves the first pivotal member 24 about the axis of the first pivot 22, causing the arm portion 30 and the rod 32 to depress the spool 17 of the boom control valve 15, whereby the boom cylinders 9 are contracted to lower the booms 8. The bucket 11 is held stopped at the angle at which its bottom side 11*a* is horizontally positioned on the ground, so that the bucket 11 lowered can be placed on the ground with its bottom 11*a* invariably in horizontal contact with the ground.

When sand or earth is to be scooped up with the bucket 11, the control valve 14 is shifted from the neutral position N to the scooping position, contracting the bucket cylinders 12 almost to the limit position and moving the bucket 11 about the pivot 10 toward the scooping direction. Next, the lever 14 is shifted from the neutral position N to the boom-up position U, whereby the first pivotal member 24 is moved about the axis of the first pivot 22 to pull up the spool 17 of the boom control valve 15 through the arm portion 30 and the rod 32. The boom cylinders 9 therefore extend to raise the booms 8. At this time, the lever 14 is in engagement with the engaging portion 75 of the actuating member 72.

Although the bucket 11 tilts rearwardly downward with the rise of the booms 8, the cam 67 pushes up the detecting arm 82 (in the direction of arrow e in FIG. 7) before the bucket 11 reaches a position where the earth is liable to spill. The detecting arm 82 pushed up pulls the inner wire 78 of the push-pull cable 77, which in turn moves the lever 76 about the pivot 73 in the direction of arrow d shown in FIG. 3. Consequently, the actuating member 72 moves from the solid-line position to the phantom-line position shown in FIG. 8, forcibly shifting the control lever 14 from the position U to the position UD. This moves the second pivotal member 25 about the second pivot 23, thereby causing the projection 34 and the rod 36 to pull up the spool 18 of the bucket control valve 16. The bucket cylinders 12 are extended to move the bucket 11 toward the dumping direction. Thus, when the booms 8 are raised beyond a predetermined level, the bucket 11 is moved toward the dumping direction with the rise of the booms 8, precluding the bucket 11 from spilling the earth.

The rise of the booms 8 and the movement of the bucket 11 toward the dumping direction can be stopped by returning the control lever 14 from the position UD to the neutral position N along the slanting guide 76a of the actuating member 72.

To further raise the booms 8 thus stopped, the control lever 14 is shifted rearward. Since the actuating member 72 is in the phantom-line position of FIG. 8 at this time, the lever 14 invariably moves toward the position UD. When the booms 8 start rising, therefore, the bucket 11 turns toward the dumping direction with the rise to prevent spillage of earth.

FIGS. 9 to 15 show the second preferred embodiment, which will be described as to the differences thereof from the first embodiment. Throughout these drawings, like parts are designated by like reference numerals and will not be described.

Figure 12:
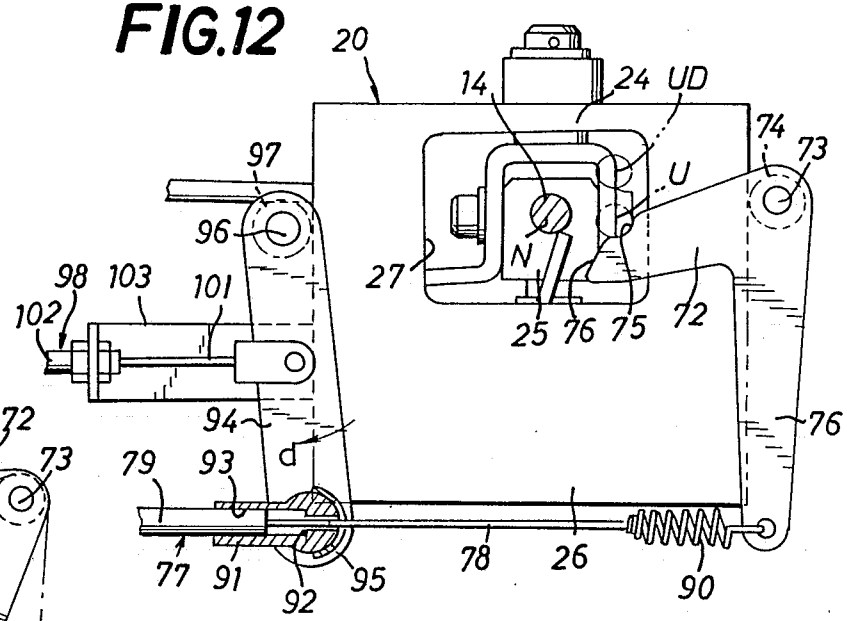

With reference to FIG. 12, the actuating member 72 has an L-shaped lever 76 which is connected to the inner wire 78 of a push-pull cable 77 by a spring 90.

The outer wire 79 of the cable 77 is axially slidably inserted in a bore 93, having a stepped portion 92, of a holder 91 and is therefore adapted to have play.

The outer wire holder 91 is fitted in and supported by a retaining portion 95 at the forward end of pivotal arm 94 and is rotatable about a vertical axis. Through a pivot 96, the pivotal arm 94 is supported at its upper portion by a tubular portion 97 at the front end of the control box 20 and is movable forward and rearward.

A push-pull cable 98 has an inner wire 101 connected to an intermediate portion of the pivotal arm 94 and an outer wire 102 attached to a holder 103 projecting forward from the control box 20.

The lever 76 is operatively connected to boom position detecting means 81 by the push-pull cable 77. The pivotal arm 94 is operatively connected to bucket position detecting means 99 by the push-pull cable 98.

Figure 14:
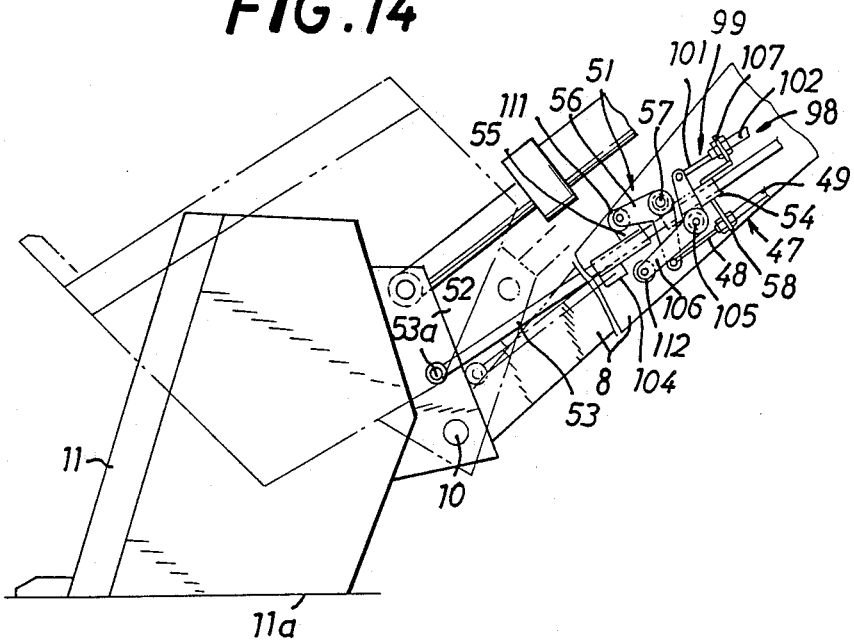
FIGS. 9 to 15 show a second preferred embodiment of the invention.
Figure 9:
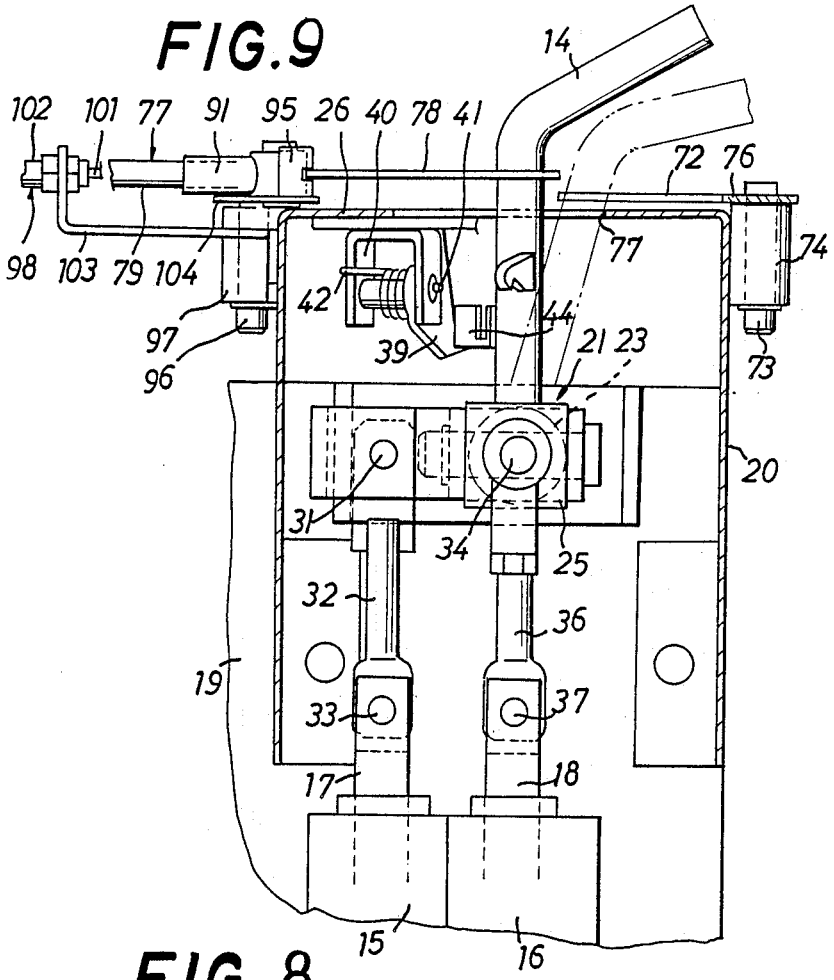

With reference to FIG. 14, the bucket position detecting means 99 has an L-shaped detecting arm 106 movable by a cam 104 on the rod 53. The detecting arm 106 is supported by a pin 105 on the boom 8 and is pivotally movable upward and downward. The inner wire 101 of the push-pull cable 98 is connected to the detecting arm 106. The outer wire 102 of the cable 98 is attached to a holder 107 secured to the guide sleeve 54.

The boom position detecting means 81 is the same as the one shown in FIG. 7. The detecting arms 56, 106 carry cam rollers 111, 112, respectively, at their forward ends.

The second embodiment operates in the following manner.

Figure 15:
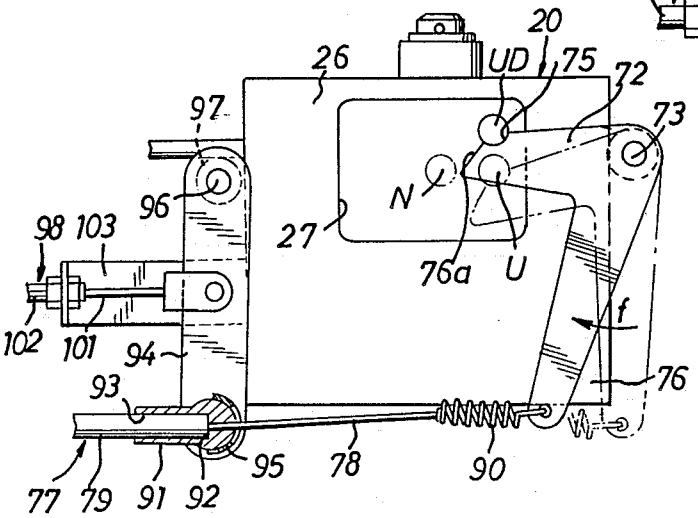

To scoop up sand or earth with the bucket 11, the control lever 14 is shifted from the neutral position N to the scooping position, contracting the bucket cylinders 12 almost to the limit position to move the bucket 11 about the pivot 10 in the scooping direction as indicated in phantom line in FIG. 14. This moves the rod 53 rearward, causing the cam 104 to pivotally move the detecting arm 106 counterclockwise to pull the inner wire 101 of the push-pull cable 98, which in turn moves the pivotal arm 94 about the pivot 96 in the direction of arrow d in FIG. 12. Consequently, the outer wire 79 of the push-pull cable 77 comes into contact with the stepped portion of the outer wire holder 91 to eliminate the play of the outer wire 79 as seen in FIG. 15.

Next, when the control lever 14 is shifted from the neutral position N to the boom-up position U, the first pivotal member 24 moves about the axis of the first pivot 22, causing the arm portion 30 and the rod 32 to pull up the spool 17 of the boom control valve 15, so that the boom cylinders 9 extend to raise the booms 8. At this time, the control lever 14 engages the engaging portion 75 of the operating member 72.

The bucket 11 tilts rearwardly downward with the rise of the booms 8, but before the bucket reaches a position where it is liable to spill the earth (phantom-line position B in FIG. 13), the cam 67 pushes up the detecting arm 82 (direction of arrow e in FIG. 7). The arm 82 pushed up pulls the inner wire 78 of the cable 77, which in turn moves the lever 76 about the pivot 73 in the direction of arrow f in FIG. 15. Consequently, the actuating member 72 forcibly shifts the control lever 14 from the position U to the position UD. This moves the second pivotal member 25 about the second pivot 23, causing the projection 34 and the rod 36 to pull up the spool 18 of the bucket control valve 16, whereby the bucket cylinders 12 are extended to move the bucket 11 in the dumping direction.

Figure 13:
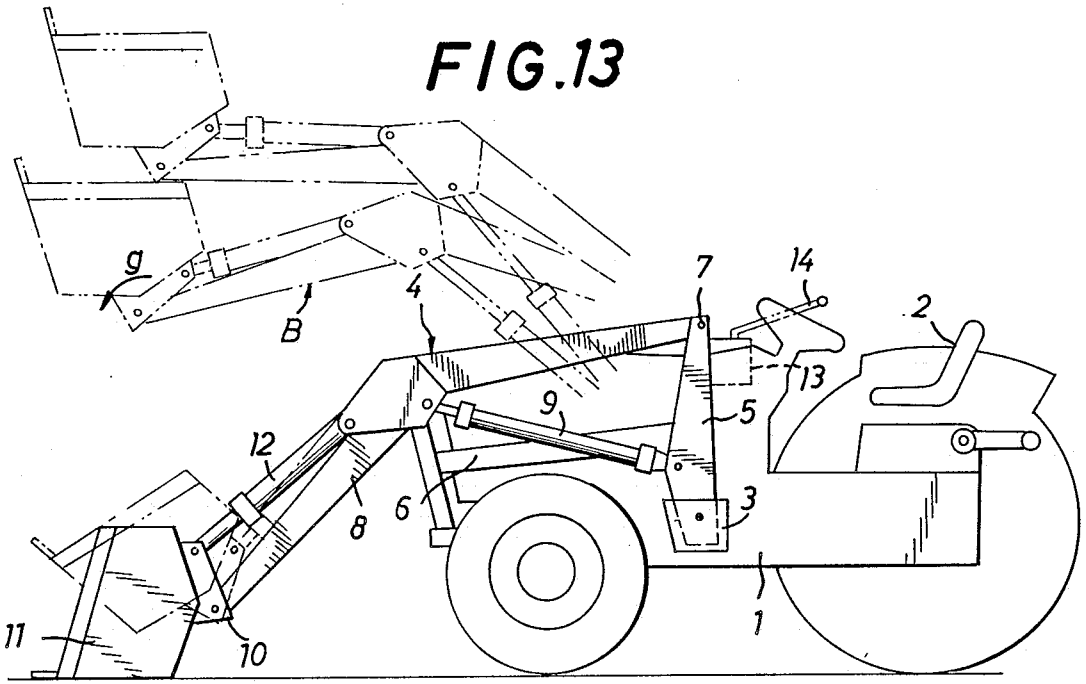

Accordingly, when the booms 8 rise beyond the phantom-line position B in FIG. 13, the bucket 11 turns toward the dumping direction (indicated by arrow g) with the rise of the booms 8. Thus, the bucket 11 is held with its opening up and with the plane of the opening approximately in a horizontal position without allowing spillage of the earth therefrom.

When the booms 8 are raised without moving the bucket 11 in the scooping direction, the cam 104 of the bucket position detecting means 99 remains unmoved, with the result that the detecting arm 106 remains unmoved to hold the pivotal arm 94 in the position shown in FIG. 12, permitting the outer wire 79 of the push-pull cable 77 to have axial play. Accordingly, even if the boom position detecting means 81 pulls the inner wire 78 with the rise of the booms 8, the outer wire 79 sliding moves within the bore 93 of the holder 91 without moving the lever 76. The actuating member 72 is therefore held out of operation, obviating the likelihood that the control lever 14 will be forcibly shifted from the position U to the position UD.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A front loader comprising upwardly and downwardly pivotable booms attachable to a vehicle body and a work implement attached to forward ends of the booms and pivotally movable in a scooping direction and a dumping direction, each of the booms and the implement being pivotally movable by a single control lever independently of each other and also at the same time, and an apparatus for controlling the posture of the front loader, the apparatus comprising boom position detecting means for detecting whether each boom is positioned at or above a specified lever, implement position detecting means for detecting whether the work implement is positioned at least at a specified angle in the scooping direction relative to the boom, and actuating means for shifting the control lever from a boom-up position to a boom-up and implement-dumping position upon the boom position detecting means detecting the boom being positioned at or above the specified level and upon the implement position detecting means detecting the implement being positioned at or beyond the specified angle in the scooping direction relative to the boom, the boom position detecting means being operatively connected to the actuating means by a push-pull cable, the cable being operable in a direction to operate the actuating means when the boom is pivotally moved to the specified level or higher, the implement position detecting means being operatively connected to a pivotal arm, the push-pull cable including an outer wire axially movably supported by the pivotal arm and changeable by the movement of the pivotal arm to a state having axial play or alternatively to a state failing to have axial play, the pivotal arm being movable in a direction to eliminate the play of the outer wire upon the implement position detecting means detecting that the implement is positioned at least at the specified angle in the scooping direction relative to the boom.

2. The apparatus as defined in claim 1, wherein the boom position detecting means comprises a cam connected to the boom and a detecting arm connected to a member attachable to the vehicle body, the detecting arm being operatively connected to the actuating means by the push-pull cable.

3. The apparatus as defined in claim 1, wherein the implement position detecting means comprises a cam connected to the implement and a detecting arm connected to the boom, the detecting arm being operatively connected to the pivotal arm.

4. The apparatus as defined in claim 3, wherein the cam is mounted on a rod, and the rod is pivoted to the implement by a first pin and held by a guide sleeve extending along the boom and pivoted to the boom by a second pin, the detecting arm being pivotally supported about a third pin, the pivotal arm being movable about a pivot, and the detecting arm being operatively connected to the pivotal arm by a push-pull cable.

5. The apparatus as defined in any one of claim 1, 2, 3 and 4, wherein the actuating means comprises an actuating member pivotally provided in the vicinity of the control lever.

6. A front loader comprising upwardly and downwardly pivotable booms attachable to a vehicle body and a work implement attached to forward ends of the boom sand pivotally movable in a scooping direction and a dumping direction, each of the booms and the implement being pivotally movable by a single control lever independently of each other and also at the same time, and an apparatus for controlling the posture of the front loader, the apparatus comprising boom position detecting means for detecting whether each boom is positioned at or above a specified level, implement position detecting means for detecting whether the work implement is positioned at least at a specified angle in the scooping direction relative to the boom, and actuating means for shifting the control lever form a boom-up position to a boom-up and implement-dumping position upon the boom position detecting means detecting the boom being positioned at or above the specified level and upon the implement position detecting means detecting the implement being positioned at or beyond the specified angle in the scooping direction relative to the boom, the boom position detecting means comprising a cam connected to the boom and a detecting arm connected to a member attachable to the vehicle body, the detecting arm being operatively connected to the actuating means by a push-pull cable, the detecting arm being movable by the cam in a direction to operate the actuating means when the boom is pivotally moved to the specified level or higher, the implement position detecting means comprising a cam connected to the implement and a detecting arm connected to the boom, the detecting arm being operatively connected to a pivotal arm, the push-pull cable including an outer wire axially movably supported by the pivotal arm and changeable by the movement of the pivotal arm to a state having axial play or alternatively to a state failing to have axial play, the detecting arm being movable by the cam so as to cause the pivotal arm to move in a direction to eliminate the play of the outer wire when the implement is position at least at the specified angle in the scooping direction relative to the boom.

7. The apparatus as defined in claim 6, wherein the cam is mounted on a rod, and the rod is pivoted to the implement by a first pin and held by a guide sleeve extending along the boom and pivoted to the boom by a second pin, the detecting arm being pivotally supported about a third pin, the pivotal arm being movable about a pivot, and the detecting arm being operatively connected to the pivotal arm by a push-pull cable.

8. The apparatus as defined in claim 7, wherein the actuating means comprises an actuating member pivotally provided in the vicinity of the control lever.

9. The apparatus as defined in claim 6, wherein the actuating means comprises an actuating member pivotally provided int eh vicinity of the control lever.

10. The apparatus as defined in claim 9, wherein the implement is further pivotally supported by a rod having a first pin and the rod is extended along the boom and is held by a guide sleeve which is pivotable about a second pin secured to the boom, the detecting arm being pivotally supported about a third pin, the actuating member being pivotally supported about a fourth pin, the detecting arm being operatively connected to the actuating member by the push-pull cable, and wherein the detecting arm is pivotally supported about a fifth pin, and the pivotal arm is pivotally supported about a sixth pin, the detecting arm being operatively connected to a pivotal arm by a push-pull cable.

11. An apparatus for controlling posture of a front loader, said front loader comprising a boom pivotally attached to a vehicle body, said boom being upwardly and downwardly pivotable, a work implement pivotally attached to a front end of the boom, said work implement being pivotable between a scooping posture and a dumping posture, said boom and said work implement being one of simultaneously and sequentially operated by a single, movable lever whereby movement of the lever along a first axis causes pivotable movement of the boom while movement of the lever along a second axis generally transverse to the first axis causes pivotable movement of the work implement and movement of the lever in an intermediate direction causes simultaneous pivotable movement of the boom and the work implement, said apparatus comprising:

means for controlling the lever such that when the boom reaches a predetermined height and continues to move upwardly the lever is shifted in response to continued upward movement of the boom from a first position for causing boom pivoting to a second position for causing continued upward movement of the boom and the movement of the work implement toward the dumping posture, said means for controlling comprising an actuating member movably set about a pivot, said actuating member having an engaging side for engaging the lever upon movement about the pivot whereby the engaging side of the actuating member moves the lever to the second position; and means for detecting a position of the boom to determine when the boom is above the predetermined height, and means for detecting a position of the work implement to determine whether the work implement reaches a predetermined angle for dumping, wherein when the boom reaches the predetermined height and the work implement reaches the predetermined angle, the lever is shifted in response thereto from the first position to the second position, the means for detecting a position of the boom is connected to the actuating member by a push-pull cable, the push-pull cable actuating the actuating member upon pivotable movement of the boom reaching the predetermined height, the means for detecting a position of the work implement being operatively connected to a pivotal arm and an outer cable of the push-pull cable being supported by the pivotal arm to be axially movable, wherein the outer cable is shifted by pivoting of the pivotal arm to selectively be in one of an axially playable state and an axially unplayable state, and wherein the pivotal arm is acted on to cause the outer cable to lose the playable state upon detection that the work implement has turned past the predetermined angle to the dumping posture.

12. The apparatus as defined in claim 11, wherein the actuating member has an oblique guide side which guides the lever from the second position to a neutral position upon contact therewith and upon movement of the actuating member.

13. The apparatus as defined in claim 11 or 12, further comprising means for detecting a position of the boom to determine when the boom is above the predetermined height, the actuating member guides the lever from the first position to the second position when the means for detecting determines the boom to be above the predetermined height.

14. The apparatus as defined in claim 13, further comprising a control box for housing the means for detecting, said control box and the lever being in close positional relationship to a pivotal point of the boom.

15. The apparatus as defined in claim 13, wherein the means for detecting comprises a cam connected to the boom and a detecting arm connected to a member attachable to the vehicle body, the detecting arm being operatively connected to the actuating member whereby when the boom reaches the predetermined height, the height is detected by the cam which then causes operation of the actuating member.

16. The apparatus as defined in claim 15, wherein the detecting arm is connected to the actuating member by a push-pull cable and is pivotable in response to movement of the push-pull cable.

17. The apparatus as defined in claim 11, wherein the means for detecting a position of the work implement is provided at a position on a side of the boom and above a point of pivotable attachment of the work implement to the boom.

* * * * *